US005419085A

United States Patent [19]

Imbur

[11] Patent Number: 5,419,085

[45] Date of Patent: May 30, 1995

[54] INTERIOR SHUTTER WITH CONCEALED HINGES

[76] Inventor: James E. Imbur, 217 A W. 7th St., Richmond, Va. 23224

[21] Appl. No.: 210,447

[22] Filed: Mar. 21, 1994

[51] Int. Cl.[6] ..... E05D 7/00

[52] U.S. Cl. ..... 49/398; 16/238; 49/64; 49/169

[58] Field of Search ..... 49/398, 386, 402, 74.1, 49/64, 51, 163, 168, 169; 16/236, 237, 238, 242, 247

[56] References Cited

U.S. PATENT DOCUMENTS

| | | | |
|---|---|---|---|
| 84,124 | 11/1868 | Jenkins | 49/74.1 |
| 3,183,547 | 5/1965 | Bury | 16/238 |
| 3,390,486 | 7/1968 | Walters | 16/237 X |
| 3,932,959 | 1/1976 | Jansons et al. | 49/74.1 |
| 4,177,540 | 12/1979 | Gorton | 49/398 X |
| 4,583,261 | 4/1986 | Rock et al. | 16/238 |
| 4,620,343 | 11/1986 | Grass | 16/236 |
| 4,761,852 | 8/1988 | Sauber | 16/247 X |
| 4,776,061 | 10/1988 | Franco | 16/236 |
| 5,063,638 | 11/1991 | Howard et al. | 49/398 X |

FOREIGN PATENT DOCUMENTS

| | | | |
|---|---|---|---|
| 2601809 | 7/1977 | Germany | 16/237 |

*Primary Examiner*—Philip C. Kannan

[57] ABSTRACT

This invention consists of a window shutter that eliminates the need for hanging strips which are aesthetically unpleasing and also prevent tilt in windows from pivoting inward as designed. Aesthetically the shutter is more pleasing to the view as the hinges and hinge pins are concealed from view when the shutter is closed. The shutter features two or three dimensional adjustment of shutter position with respect to the frame thereby allowing easy positional adjustment without requiring the use of a hanging strip and have a decorative edge that provides a clearance and permits the shutters to open to 120° or more.

5 Claims, 3 Drawing Sheets

INTERIOR SHUTTER WITH CONCEALED HINGES

FIELD OF THE INVENTION

This invention relates to window shutters, and particularly, to an improved shutter which eliminates the need for hanging strips, contains hinges that are concealed from view when the shutter panels are in the closed position, and features a simple means of making two or three dimensional final adjustment of the shutter position with respect to the frame without dismantling the shutter from the frame.

BACKGROUND OF THE INVENTION

Interior shutters are typically hinged with mortised hinges that are connected to a wood or aluminum hanging strip which is in turn attached to the window casing.

For a typical interior shutter, the sides of the hinges show as well as the hinge pins. Also, the hanging strips prevent tilt-in-windows from pivoting inward as designed.

SUMMARY OF THE INVENTION

One object of the invention is to provide a window shutter that eliminates the need for hanging strips. Hanging strips are aesthetically unpleasing and also prevent tilt-in-windows from pivoting inward as designed.

A second object of the invention is to provide a hinge for interior window shutters that is invisible when the shutter is closed. Virtually no part of the hinge is visible when the shutters are closed.

A third object of the invention is to provide a hinge for interior shutters that offers either two or three dimensional hinge adjustment without requiring the use of a hanging strip.

Other objects and advantages of the present invention will be better understood from the following description when read in conjunction with the appropriate drawings.

DESCRIPTION OF THE INVENTION

Figure 1:
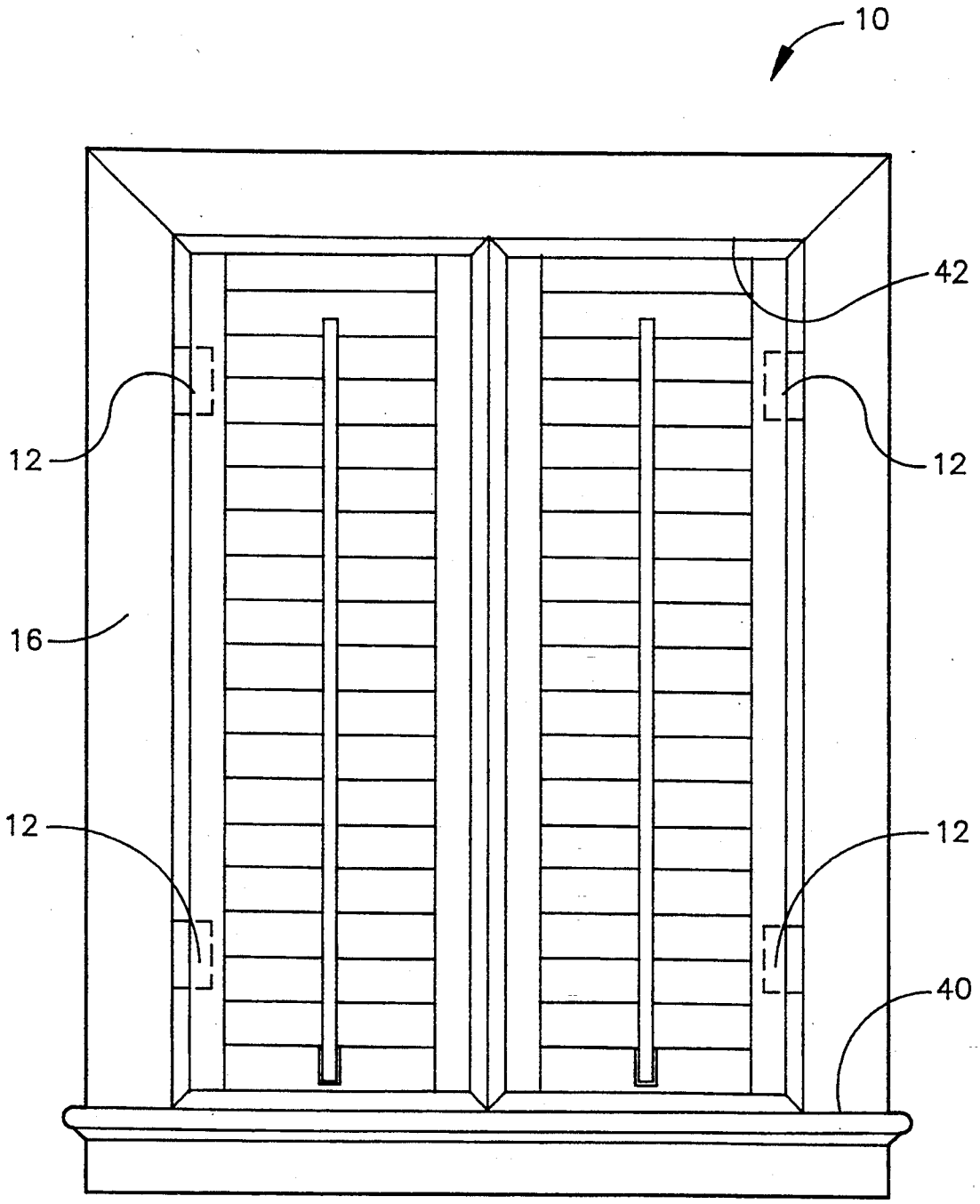
FIG. 1 is a front elevational view of a window shutter mounted with the concealed hinge of the present invention.

An interior window shutter assembly 10 in accordance with the invention is shown in FIG. 1. As shown in the drawing, no portion of the hinge is visible when the paired shutters 14 are in the fully closed position. The hinge 12 is shown in phantom lines only to depict its position in relation to the shutter 14. Also depicted in FIG. 1 is the window frame 16, to which the frame member of the hinge is connected.

Figure 2:
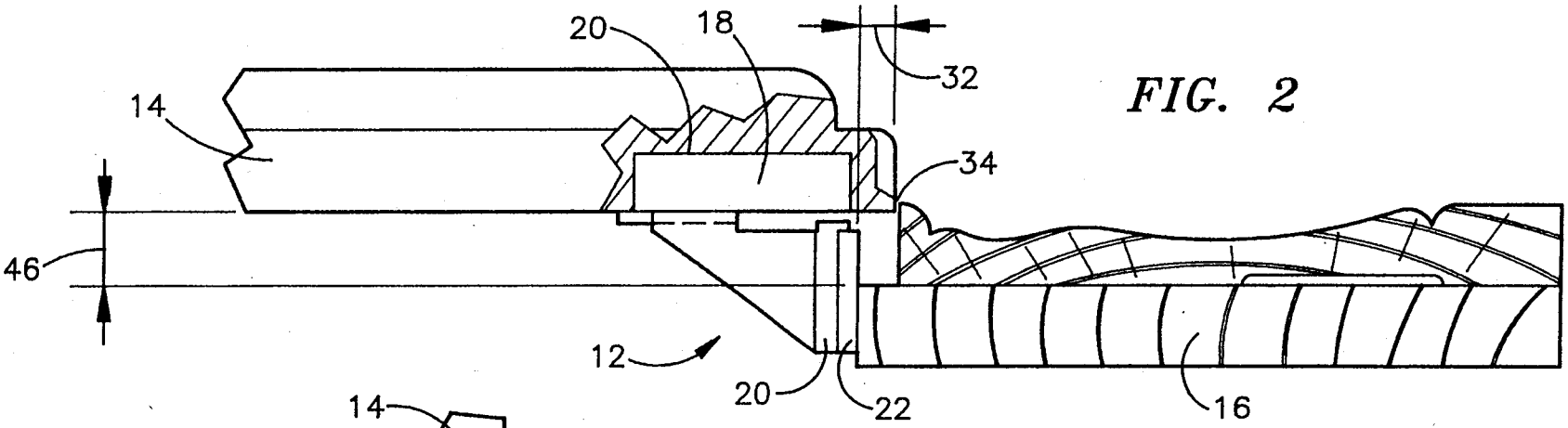
FIG. 2 is a partial overhead view of the shutter, frame, and hinge of the present invention with the shutter in the closed position.

FIG. 2 depicts a partial overhead view of the shutter 14, frame 16, and hinge 12 of the present invention with the shutter in the closed position. The hinge illustrated is more fully disclosed in Rock et al. U.S. Pat. No. 4,583,261 incorporated herein by reference and made a part hereof. Similar hinges such as Mepla TM, Amerock TM, and Grass TM, etc. may be used. These hinges are commonly available and are normally used for another purpose. A portion of the shutter 14 is cut away to reveal the shutter member 18 of the hinge 12 which is mounted in a hollowed out area 19 located on the back side of the shutter so that the hinge is concealed and its pivot point is located on the back side of the shutter.

Also shown in FIG. 2 is a base plate 22 which may be inserted between the facing of the frame member 20 and the frame 16 when connecting the hinge 12 to the inside side of frame 16. Use of the base plate 22 provides an additional means of adjusting the position of the shutter with respect to the frame 16.

Figure 3:
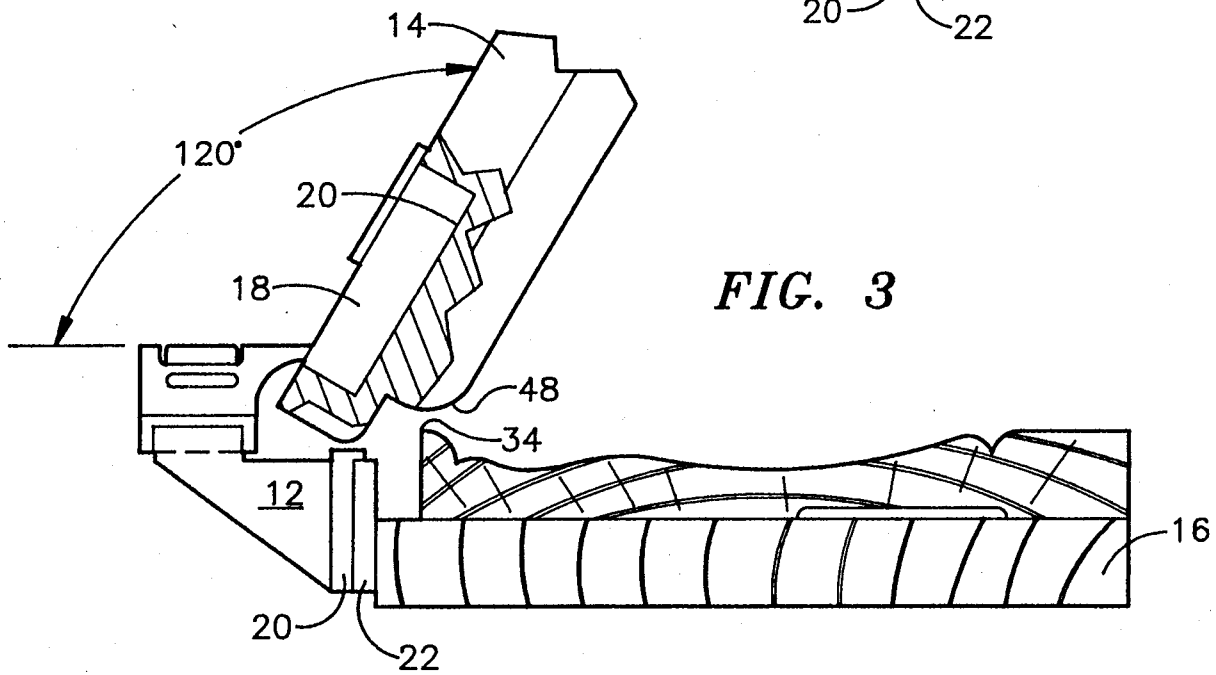
FIG. 3 is a partial overhead view of the shutter, frame, and hinge of the present invention with the shutter in the open position.

FIG. 3 is a partial overhead view of the shutter 14, frame 16, and hinge 12 with the shutter 14 in the full open position. Hinges such as the Rock et al. hinge depicted in the drawing are biased to the fully closed position when closed. When applying force to open the shutter 14, at some point the resistance that biases the shutter 14 toward the closed position is overcome and the biasing action is reversed such that the shutter 14 is then biased toward the fully open position as depicted in FIG. 3. The fully open position is approximately 120°.

Critical to this opening and an important part of this invention is the unique molding outward contour 48 which provides both an attractive edging and a clearance that permits the shutter to open beyond 90° to 120° or more.

Figure 4:
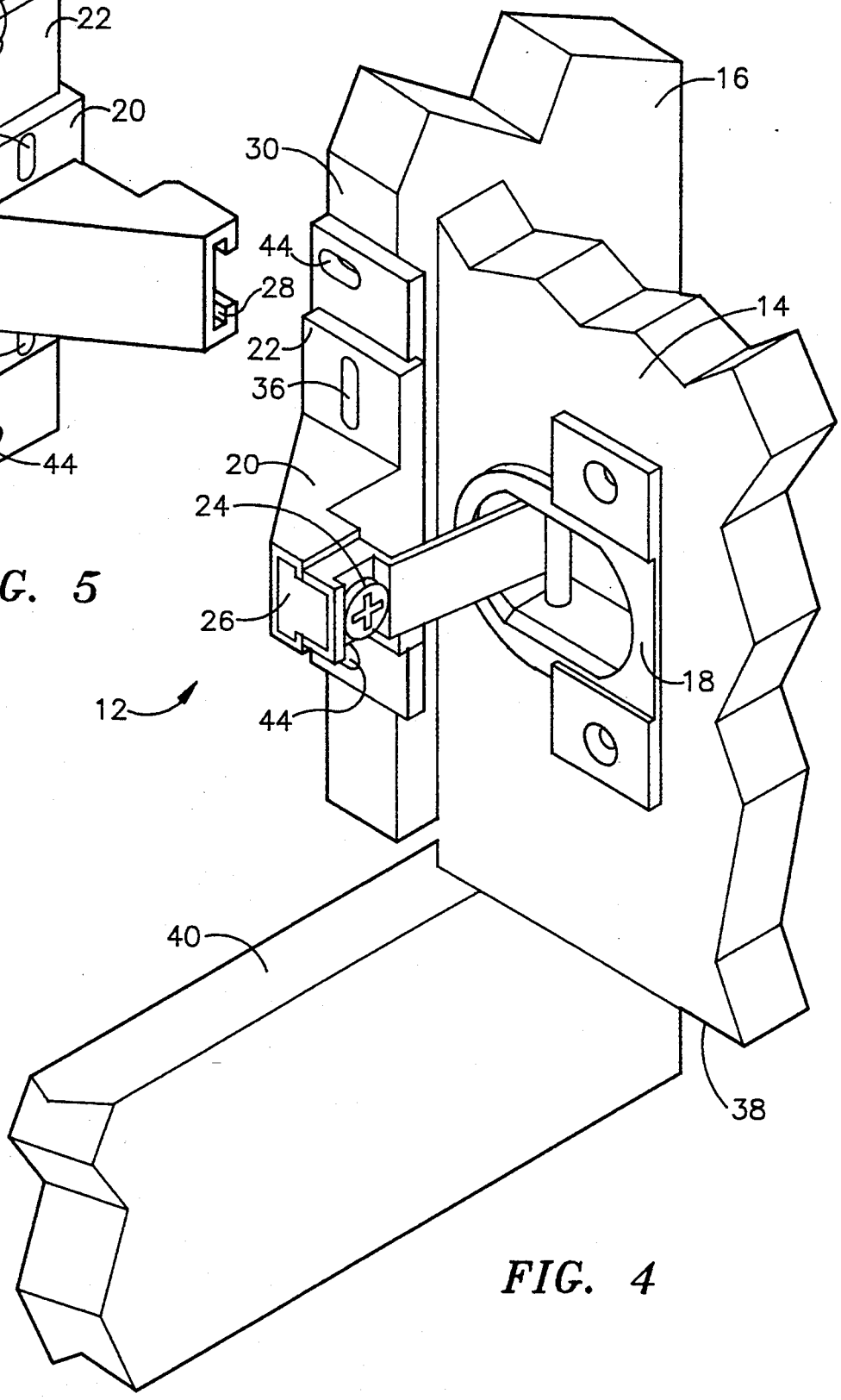
FIG. 4 is a perspective view of the hinge including a cutaway portion of the frame and shutter showing especially the three areas where adjustments may be made in hanging the shutter.

FIG. 4 is a perspective view of the hinge including a cutaway portion of the frame 16 and shutter 14 showing especially the three areas where adjustments may be made in fixing the position of the shutter 14 with respect to the frame 16.

The first point of adjustment is by screw 24 acting upon nut 26 or other connecting means which slidably attaches the frame member 20 of the hinge 12 to the shutter member 18. By loosening screw 24, nut 26 is slidably disposed within groove 28 in frame member 20, depicted in FIG. 5, thereby allowing adjustment in the overlap of shutter 14 upon frame 16. By means of this adjustment, shutter 14 is typically positioned to effect complete overlap of facing vertical edge 30 of frame 16. The overlap, as shown in FIG. 2, is adjusted such that hinge 12 may be completely hidden from a frontal view when shutter 14 is closed, such as is shown in FIG. 1. The overlap 32 is also adjusted such that shutter 14 does not contact the edge 34 of the decorative molding as may exist on the frame 16.

Figure 5:
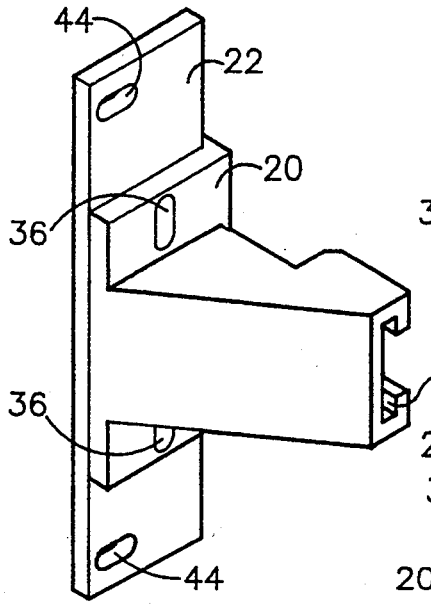
FIG. 5 is a perspective view of the adjustment plate and connector which attach to the window frame in the present invention.

The second point of adjustment of shutter 14 with respect to frame 16 is by vertical slots 36 in frame member 20 of hinge 12. The upper vertical slot 36 is depicted in FIG. 4 and FIG. 5 and a portion of the lower vertical slot 36 is in view in FIG. 5. Typically frame member 20 is connected with screws which tighten into base plate 22. Vertical adjustment of shutter 14 is therefore accomplished by loosening the threaded screws, not shown in FIG. 4, that connect frame member 20 to base plate 22. Once the screws are loosened on both the upper and lower vertical slots 36 of both the upper and lower hinges 12 connecting the shutter 14 to the frame 16, the shutter 14 may be adjusted vertically to create the proper clearance between the bottom edge 38 of shutter 14 and top edge 40 of lower horizontal member of frame 16. Typically, if the shutter is a full length shutter that extends from top edge 40 of lower horizontal member to bottom edge 42 of upper horizontal member of frame 16, as shown in FIG. 1, the shutter 14 is adjusted vertically through vertical slots 36 to effect proper clearance between shutter 14 and frame 16 on both the top and bottom.

The third point of adjustment, which may optionally be omitted if desired, is through horizontal slots 44, the upper of which is depicted entirely and the lower of which is partially depicted in FIG. 4 and both of which are depicted in FIG. 5. By loosening screws, not depicted in the figures, holding base plate 22 to vertical facing edge 30 of frame 16, the stand off distance of shutter 14 from frame 16 may be adjusted. The stand off distance 46, depicted in FIG. 2, is adjusted to prevent the outward contour 48 of shutter 14 from interfering with decorative edge 34 of frame 16 when shutter 14 is pulled to the open position as shown in FIG. 3. The stand off distance 46 may also be adjusted to create the aesthetic effect desired in joining the outer contour of the shutter 14 and frame 16.

It has therefore been shown that the concealed shutter hinge of this invention may have areas on each hinge arrangement for effecting the desired clearances, the desired swinging action of shutter upon frame, and the desired aesthetic effect.

From the foregoing, it will be apparent that the present invention brings to the art a novel and improved shutter containing a concealed hinge in which as many as three separate adjustments may be made to enable attaining the proper operational and desired aesthetic effects of a decorative shutter.

Having thus described the invention with reference to a preferred embodiment, it is to be understood that the invention is not so limited by the description herein but is defined as follows by the appended claims.

What is claimed is:

1. An indoor shutter with concealed hinges for use with a window frame having sides comprising:

an indoor shutter having an outward border contour that provides both a decorative edge and a clearance recess that enables said shutter to be opened beyond 90 degrees to at least approximately 120 degrees;

concealed hinges each having a frame member for attachment to said side of said window frame without the use of hanging strips and a shutter member attached to said shutter at the backside thereof;

a first adjustment connection for said hinges for adjustment in one direction; and a second adjustment connection for adjusting said hinge in a direction which is perpendicular to said first adjustment connection.

2. The shutter of claim 1 wherein said first adjustment connection is located between said frame member and said shutter member.

3. The shutter of claim 2 wherein said shutter is designed to overlap over said window frame and may be adjusted by loosening a screw or other connecting means associated with said first adjustment connection which holds said frame member of said hinge fixed with respect to said shutter member of said hinge, said screw or other connecting means acting upon a nut which is slidably disposed within said frame member of said hinge which allows the movement of said shutter with respect to said window frame.

4. The shutter of claim 1 further comprising a base plate for disposal between said frame member and said window frame, said base plate containing horizontal slots to allow as a third adjustment the standoff of said shutter from said window frame.

5. The shutter of claim 1 wherein said second adjustment arrangement includes at least one vertical slot on said frame member for allowing adjustment of the vertical position of said shutter with respect to said window frame by means of a screw or other connecting means affixed through said vertical slot.

* * * * *